US010132055B2

(12) United States Patent
Sharkey

(10) Patent No.: US 10,132,055 B2
(45) Date of Patent: Nov. 20, 2018

(54) CLAMSHELL SCOOP ATTACHMENT FOR WORK VEHICLE

(71) Applicant: James Sharkey, Oswego, NY (US)

(72) Inventor: James Sharkey, Oswego, NY (US)

( * ) Notice: Subject to any disclaimer, the term of this patent is extended or adjusted under 35 U.S.C. 154(b) by 0 days.

(21) Appl. No.: 15/288,432

(22) Filed: Oct. 7, 2016

(65) Prior Publication Data

US 2018/0100287 A1 Apr. 12, 2018

(51) Int. Cl.
*E02F 3/34* (2006.01)
*E02F 3/407* (2006.01)
*E02F 3/40* (2006.01)

(52) U.S. Cl.
CPC ..... *E02F 3/4075* (2013.01); *E02F 3/34* (2013.01); *E02F 3/404* (2013.01)

(58) Field of Classification Search
CPC ..... E02F 3/4075; E02F 3/34; E02F 3/404
USPC ..... 414/722
See application file for complete search history.

(56) References Cited

U.S. PATENT DOCUMENTS 2,979,215 A 4/1961 Brisson
3,987,562 A 10/1976 Deen et al.
4,633,601 A * 1/1987 Fleck ..... E02F 3/401 37/444
4,928,410 A * 5/1990 Walters ..... E02F 3/404 172/254
5,114,296 A * 5/1992 Badder ..... B66F 9/19 37/444
5,209,002 A 5/1993 Tranquilli et al.
5,674,046 A 10/1997 Meyer
6,116,846 A 9/2000 Bulkley
6,119,377 A * 9/2000 Rubio ..... E02F 3/3414 37/403
6,662,480 B1 * 12/2003 Stevens ..... E02F 3/4075 172/817
7,789,613 B1 9/2010 Weinlader
8,006,414 B2 8/2011 Leonard
2002/0044862 A1 * 4/2002 Burton ..... E02F 3/34 414/724
2006/0073004 A1 * 4/2006 Drexelius ..... E02F 3/4075 414/719
2007/0092366 A1 * 4/2007 Bose ..... B60R 9/06 414/607
2009/0223094 A1 * 9/2009 Boyer ..... E02F 3/38 37/403
2014/0064826 A1 * 3/2014 Clifford ..... E01H 5/061 403/53

* cited by examiner

*Primary Examiner* — Michael S Lowe
(74) *Attorney, Agent, or Firm* — Bernhard P. Molldrem, Jr.

(57) ABSTRACT

A front-mounted clamshell scoop or shovel arrangement mounts onto the snowplow mounting bracket of the frame of a snowplow assembly when the blade has been removed. The scoop can be closed and lowered to scoop and pick up work-site debris or other materials, raised so the materials can be transported to a collection site, and the jaw portion is rocked to an open position to allow the material to drop from the clamshell scoop. In controls for the snowplow assembly serve to raise and lower the scoop and to open and close it.

10 Claims, 3 Drawing Sheets

CLAMSHELL SCOOP ATTACHMENT FOR WORK VEHICLE

BACKGROUND OF THE INVENTION

This invention relates scoops or shovels that can be removably mounted on a pickup truck or similar work vehicle. The invention is more particularly concerned with a clamshell scoop arrangement which can replace the snow-plow blade of the work vehicle so that the same controls that are used to lift and lower the snowplow blade and to angle the blade right or left can be used to raise and lower the scoop or shovel to pick up dirt or debris from a work site and to open and close the device so that the dirt or debris can be deposited at a collection or dump site. Many pickup trucks are fitted with a front-mounted snow-plow attachment where a frame is mounted on the bumper or frame of the truck, and a snowplow blade is removably attached onto a plow bracket on the frame. These are typically hydraulically operated, with a hydraulic pump powered by the vehicle engine feeding hydraulic fluid through one hydraulic circuit to a lift cylinder or pair of cylinders that lift and lower the plow bracket and blade, and through another hydraulic circuit to another cylinder or cylinders that angle the blade right, left, or center. Each hydraulic circuit has its own control lever in the cab of the vehicle so that the operator can control the snowplow blade.

At the same time, at most work sites, e.g., where there is excavation or construction, there is a need to cleanup debris that is generated during the day, but there are no simple power tools for carrying out this function. This means that either the workers need to shovel the debris by hand into the bed of a truck to transport the debris to the collection site, or that another work vehicle, such as a front loader or bulldozer, has to be diverted for this clean-up function. These vehicles are not always available.

Accordingly, there has been a need for some mechanism to allow the workers to use standard utility vehicle, e.g., pick-up truck for this clean-up purpose. Even though many of these vehicles are converted in winter to snowplowing activities, no one has previously considered a simple conversion of the snow plow function for a clean-up use during the construction season.

OBJECTS AND SUMMARY OF THE INVENTION

Accordingly, it is an object to provide a novel conversion system to convert the snowplow mount and hydraulic systems already on the vehicle to a shovel or scoop of simple design that allows the operator to use the same controls for the snowplow as controls for the scoop or shovel.

A more specific object of this invention is to provide a front-mounted clamshell scoop or shovel arrangement that mounts upon the snowplow mounting bracket of the frame of the snowplow assembly, when the blade has been removed, which can be closed and lowered to scoop and pick up debris or other materials from the work site, and which can be raised so the materials can be transported to the debris collection site, and then which can be opened to allow the material to drop from the clamshell scoop.

It is a related object to employ the same in-cab controls that are part of the snowplow assembly to raise and lower the scoop and to open and close it.

According to an aspect of the present invention, a clamshell scoop front attachment for a pickup truck or other utility work vehicle is adapted to attach onto a frame of a front-mounted snow-plow assembly that has been fitted onto the vehicle. The snow-plow assembly frame has a plow bracket onto which the snow-plow blade is attached, but can be removed when not needed. The frame includes a hydraulic actuator or pair of hydraulic actuators for controllably raising and lowering plow bracket and plow blade. A hydraulic circuit is connected with at hydraulic lift actuator(s) for controllably raising and lowering the plow bracket and plow. There is also another hydraulic circuit adapted to be removably connected with a second hydraulic actuator or actuators mounted upon the snow plow blade which is used for orienting the direction of the blade so it can be angled right, left or straight. In order to avail itself of these features, the clamshell scoop assembly includes a back plate having a lower edge, and a with scoop bracket affixed onto the back plate and adapted for removably mounting onto the plow bracket (favorably, the scoop bracket is rigidly affixed onto the back plate); a jaw or movable portion that has a bottom plate with a front edge and a rear edge, and side walls rising from the bottom plate; a transverse pivot member or members joining upper pivot portions of the side walls of the jaw member to corresponding pivot portions of the back wall, and thus defining a transverse pivot axis at an upper part of the clamshell assembly; and at least one additional actuator, e.g., hydraulic cylinder(s) coupled to the plate and to the jaw for controllably moving the jaw about the transverse pivot axis between an open position and a closed position. In the closed position jaw is rotated down such that the back edge of said bottom plate is at or behind the lower edge of the back plate and beneath the lower edge of the back plate, such that debris and other materials remains in the scoop. In the open position the jaw is rotated upward and forward, to create a gap between the rear edge of the bottom plate of the jaw and the lower edge of the back plate, so that the debris drops out through the gap.

The additional actuator(s) for opening and closing the jaw of the scoop include a coupling for removably connecting the at actuator(s) with the second hydraulic circuit, i.e, the circuit that controls the left-right orientation of the plow blade. These may include a plurality of vertically-oriented hydraulic actuators. The jaw member can favorably include a pair of lever arms affixed onto the respective side walls of the jaw member which extend rearward, beyond the back plate of the scoop assembly. In this case a rod of a respective one of the additional actuator(s) is journaled in one of both of these lever arms such that the at least one additional actuator is operative to rock said jaw member between its open and closed positions.

As an assist in retaining the collected dirt and debris in the scoop assembly, the bottom plate can include includes a transverse ridge positioned midway between the front and rear edges of the bottom wall. This can have sloping front and rear sides leading from the flat base of the bottom plate up to the ridge line.

The jaw member is open at the rear edge of the bottom plate and may have the back side entirely open.

With only minor modifications the functions of lifting/lowering of the scoop and of opening/closing the jaw may be carried out with electric linear motors, e.g., if the assembly is to be installed on a smaller utility vehicle without hydraulics.

These and other objects, features, and advantages of the invention will become apparent from the following detailed description of a selected preferred embodiment, which is to be read in connection with the accompanying Drawing:

DETAILED DESCRIPTION OF THE PREFERRED EMBODIMENT

Figure 1:
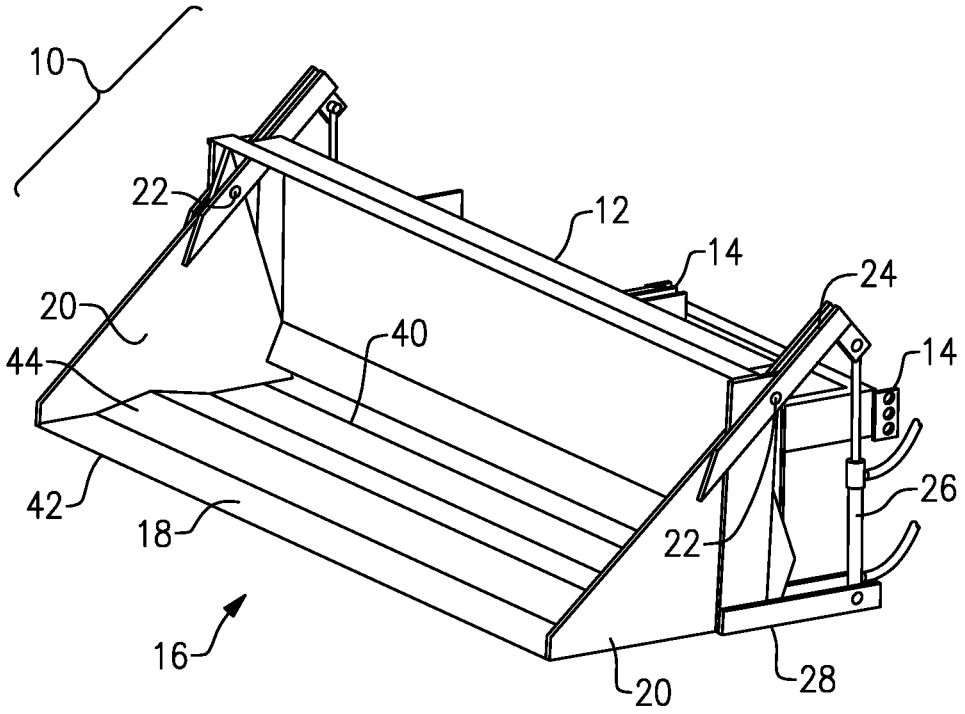
FIG. 1 is a perspective view of a clamshell scoop attachment according to an embodiment of this invention.
Figure 2:
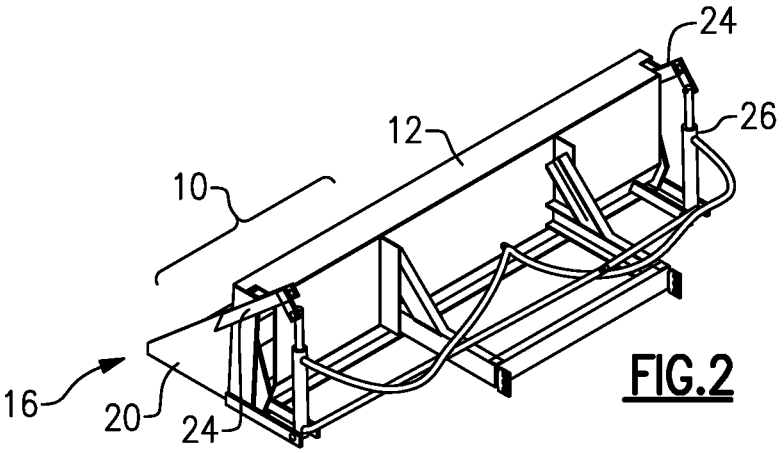
FIGS. 2 to 5 are a rear perspective, a top plan view, a left side elevation, and a rear elevation of the clamshell scoop attachment of this embodiment.
Figure 3:
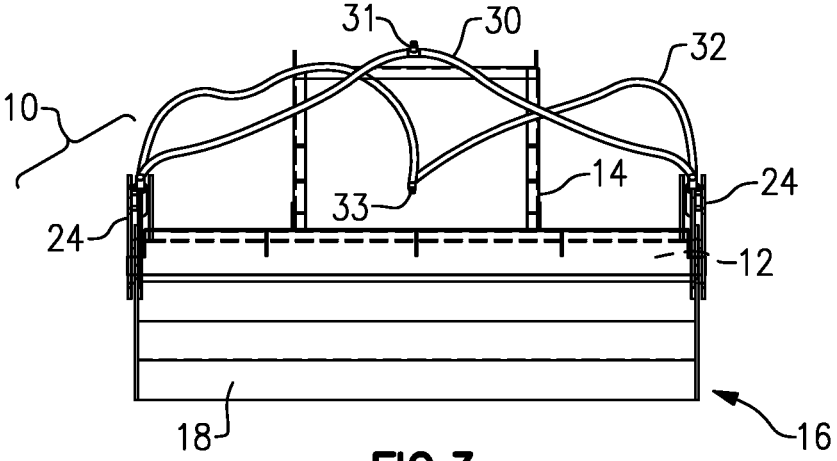
Figure 4:
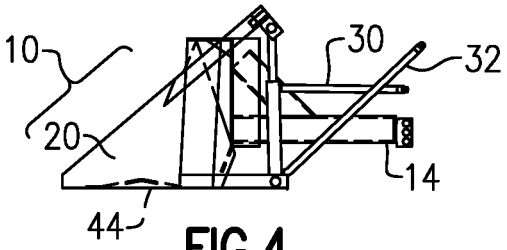
Figure 5:
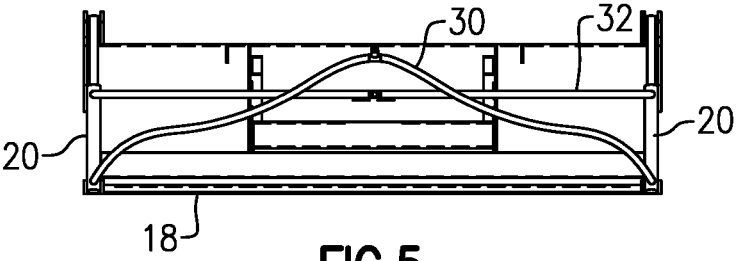

With reference to the Drawing Figures, and initially to FIG. 1, clamshell front scoop assembly 10 is configured to be mounted onto a snowplow frame on a pickup truck, in place of the snow plow blade assembly (not shown here), on a frame that is mounted to the front vehicle frame of the truck. The clamshell front scoop has a generally flat planar back plate 12 oriented vertically and extending laterally across the truck ahead of the front bumper. A mounting bracket 14 here is shown permanently affixed onto the back or proximal side of the vertical plate, and this is dimensioned to be bolted in place onto the snow plow bracket that is part of the frame of the snowplow assembly.

A jaw portion 16 of the front scoop assembly 10 is configured so as to rock or swing on a horizontal axis relative to the fixed back plate 12. The jaw portion has a normally horizontal bottom plate 18 and two vertically oriented side walls 20, 20 at right and left sides. Also shown here are pivot members 22, e.g., pivot pins, journal the upper part of the side walls 20 of the jaw member to an upper portion of the back plate 12. These define a horizontal, transverse pivot axis for the jaw member 16. Pivoting lever arms 24 extend back or proximally from upper ends of the respective side walls 20 and to each of these is connected a rod of a hydraulic actuator 26, which is vertically disposed and has its lower end attached onto a lower arm 28 that is affixed to a respective end of the back plate 12. The jaw portion 16 is open at the rear, i.e., between the two side walls 20, 20 and is open behind or proximally of a rear edge 40 of the bottom plate. The side walls extend forward to a front edge 42 of the bottom plate 18. In the lowered or closed position as shown in FIG. 1, the rear edge 40 of the bottom plate 18 is just below the bottom edge of the fixed back plate 12. Also shown in FIG. 1 is a dihedral or ridge 44 that extends transversely across the bottom plate 18 about midway between the front and rear edges 40 and 42. This ridge 44 has front and back sloping surfaces that each arise to a ridge line, as shown, and serves to keep the collected debris from spilling out over the front edge 42.

As shown in FIGS. 2 to 5, each of the two cylinders or actuators 26 has a lower port connected to a hydraulic hose or line 30 and an upper port connected to another hydraulic hose or line 32. Each of these hydraulic hoses has a connector 31 and 33, respectively, that are adapted to attach to the hydraulic circuit for the plow blade cylinder(s), i.e., the actuators used to orient the blade left, right, or forward. With the blade removed and the scoop assembly installed on the snow plow frame, that hydraulic circuit serves to open and close the jaw member, i.e., rock the jaw member on its horizontal axis between a closed position in which the bottom plate of the jaw member is approximately horizontal and with the rear edge 40 thereof at or behind the lower edge of the vertical back plate 12; and an open position where the jaw member 16 is lifted forward and upward, to open a gap between the rear edge 40 of the bottom plate 18 and the lower edge of the back plate.

Figure 6:
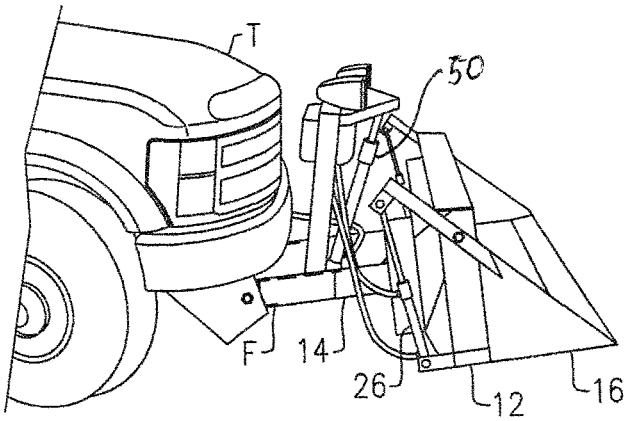
FIGS. 6 and 7 are perspective views of the clamshell scoop attachment of this embodiment mounted on a truck or similar work vehicle, here shown in the closed and open positions, respectively.
Figure 7:
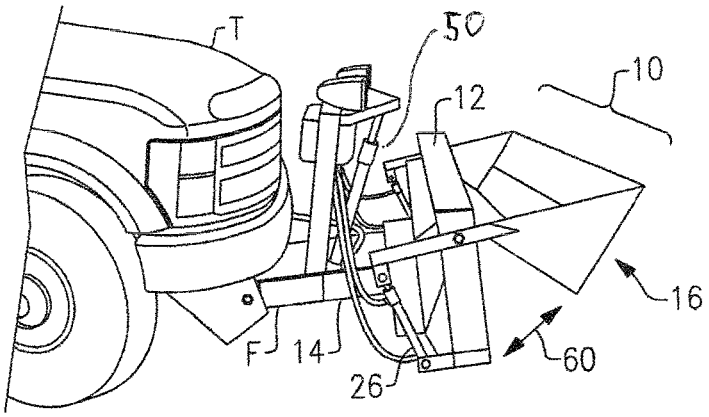

FIGS. 6 and 7 illustrate an example of the scoop assembly 10 of this embodiment mounted onto the front end of a pick-up truck T, here showing a snowplow mounting frame F attached to the truck frame at the front end. The snow plow blade, i.e., moldboard and mounting bracket, have been removed from the frame F and the mounting bracket 14 of the scoop assembly back plate 12 has been fastened in place to the frame F. As shown here, a lift cylinder or actuator 50 on the snowplow frame is configured to lift the snowplow mounting bracket, and with it the back plate 12 of the scoop and with it the jaw member. The actuators or cylinders 26 are extended to lower the jaw to the closed position shown in FIG. 6, and are retracted to rock the jaw member 16 upwards to open the gap 60 and permit collected materials to drop out behind the rear edge 40 of the jaw member bottom plate 18.

Other configurations for the front scoop assembly are possible without departing from the main principles of the present invention. The foregoing embodiment is presented as a selected example, and could be constructed in any of numerous varieties and forms. While the present invention has been described with reference to this embodiment, it should be understood that the invention is not limited to any particular embodiment. Rather, many modifications and variations would present themselves to persons skilled in the art without departure from the scope and spirit of this invention, as defined in the appended claims.

I claim:

1. Clamshell scoop front attachment adapted to attach onto a frame of a front-mounted snow-plow assembly wherein said frame includes a plow bracket adapted so that a snow-plow blade can be removably attached thereto, the frame including at least one first hydraulic actuator for controllably raising and lowering said plow bracket vertically, and the front-mounted snow-plow assembly further including a first hydraulic circuit connected with at least one first hydraulic actuator adapted for controllably raising and lowering said plow bracket, and the snow-plow assembly including a second hydraulic circuit adapted to be removably connected with a second hydraulic actuator mounted upon said snow plow blade for controllably moving said snow plow blade when said snow plow bracket is attached onto said frame;

the clamshell scoop front attachment comprising:

a. a fixed vertical back plate having a lower edge, and a scoop bracket affixed onto said back plate and adapted for removably mounting onto said plow bracket;

b. a jaw portion including a bottom plate having a front edge and a rear edge; and side walls rising from said bottom plate and having upper pivot portions thereon, the jaw portion being open above the rear edge of said bottom plate and at rear edges of said side walls;

c. at least one transverse pivot member joining the upper pivot portions of the side walls of said jaw portion to corresponding portions of said fixed, vertical back plate to permit the jaw portion to pivot up and down relative to said fixed vertical back plate, and defining a transverse pivot axis;

d. at least one additional actuator coupled to said back plate and to said jaw portion for controllably moving said jaw portion about said transverse pivot axis between an open position and a closed position wherein in said closed position said jaw portion is rotated down such that the back edge of said bottom plate is spaced below the lower edge of said back plate and at or behind the lower edge of said back plate and in the open position said jaw portion is rotated upward to create a gap between the rear edge of the bottom plate of the jaw portion and the lower edge of the back plate; the at least one additional actuator being configured to be removably connected with said second hydraulic circuit.

2. Clamshell scoop front attachment according to claim 1 wherein said at least one additional actuator includes a coupling for removably connecting the at least one additional actuator with said second hydraulic circuit and hydraulic hoses connecting said coupling with said at least one additional actuator.

3. Clamshell scoop front attachment according to claim 2 wherein said jaw portion includes a pair of lever arms affixed onto the respective side walls of the jaw portion and extending beyond said back plate, and wherein a rod of said at least one additional actuator is journaled in one or both of said lever arms such that said at least one additional actuator is operative to rock said jaw portion between its open and closed positions.

4. Clamshell scoop front attachment according to claim 1 wherein the bottom plate includes a transverse ridge that rises midway between the front and rear edges thereof.

5. Clamshell scoop front attachment according to claim 1 wherein said scoop bracket is rigidly affixed onto said back plate.

6. Clamshell scoop front attachment according to claim 1 wherein said jaw portion is open at the rear edge of said bottom plate.

7. Clamshell scoop front attachment according to claim 1 wherein said at least one additional actuator includes a plurality of vertically-oriented actuators.

8. Clamshell scoop front attachment according to claim 7 wherein said jaw member is entirely open at a back side thereof.

9. Clamshell scoop front attachment according to claim 1 wherein said frame of said front-mounted snow plow assembly is mounted onto a pick-up truck or equivalent utility vehicle.

10. Clamshell scoop front attachment according to claim 9 wherein said first hydraulic circuit and said second hydraulic circuit each include a respective in-cab control located in a cab of said pick-up or equivalent utility vehicle.

* * * * *